US006243898B1

(12) United States Patent
Ruff

(10) Patent No.: US 6,243,898 B1
(45) Date of Patent: Jun. 12, 2001

(54) MATTRESS HAVING A REMOVABLE INSERT

(76) Inventor: Danese C Ruff, 4830 Dale Dr., Columbia, SC (US) 29203

( * ) Notice: Subject to any disclaimer, the term of this patent is extended or adjusted under 35 U.S.C. 154(b) by 0 days.

(21) Appl. No.: 09/518,734

(22) Filed: Mar. 3, 2000

Related U.S. Application Data

(60) Provisional application No. 60/134,434, filed on May 17, 1999.

(51) Int. Cl.[7] ..... A61G 7/02
(52) U.S. Cl. ..... 5/695; 5/609
(58) Field of Search ..... 5/604, 695, 732; 4/450, 456

(56) References Cited

U.S. PATENT DOCUMENTS 1,054,452 * 2/1913 Sayen ..... 5/604 X
1,381,751 * 6/1921 Scanlan ..... 5/695
2,615,175 * 10/1952 Corakas ..... 5/695 X
3,146,469 * 9/1964 Slade ..... 5/695
3,419,920 * 1/1969 Maddux, Jr. et al. ..... 5/695
4,011,610 * 3/1977 Parker, III ..... 5/695 X
4,122,565 * 10/1978 Hoben ..... 5/695

* cited by examiner

*Primary Examiner*—Michael F. Trettel
(74) *Attorney, Agent, or Firm*—Michael A Mann; Nexsen Pruet Jacobs & Pollard LLC

(57) ABSTRACT

The present invention is a mattress having a centrally located cut-out portion that has an insert that fits therein. The combination of the mattress and insert provides a flat surface on which a bed ridden person can lie. The insert is removable from the cut-out portion so that a bed pan may be placed therein. The cut-out portion is designed to support the bed pan, so that the bed pan is within the boundaries of the mattress. Once the bed pan is in position, the bed ridden person may comfortably perform their excretory functions while maintaining a certain degree of discreteness and dignity. Once these functions have been performed, the bed pan is removed and the insert is repositioned. The present invention also comprises a first fitted sheet and a second fitted sheet. The first fitted sheet surround the mattress and extends within the cut-out portion, while the second fitted sheet surrounds the insert. In combination, the first and second fitted sheets provide a sanitary covering to the mattress and insert that can easily be replaced, but one that will not come loose merely from the movement of the person on the mattress.

3 Claims, 2 Drawing Sheets

MATTRESS HAVING A REMOVABLE INSERT

PRIORITY CLAIM

We claim the benefit of the priority date of U.S. Provisional Patent application No. 60/134,434, filed May 17, 1999, now lapsed, which is incorporated herein by reference.

BACKGROUND OF THE INVENTION

1. Field of the Invention

The present invention relates to a mattress. In particular, the present invention relates to a mattress having a cut-out portion so that a bed pan may be positioned therein.

2. Discussion of Background

It is estimated that there may be nearly 5 million people in the United States with limited mobility. Combined with this number are the people who undergo surgery or extended hospital stays and who may have temporary limited mobility. These people typically spend a large majority of the day in the bed, or they may be completely bed ridden. Although they may have limited mobility, their body does not stop functioning; consequently, these people must either get out of bed and go to the restroom or use a bed pan in order to perform normal bodily excretory functions.

For those who are completely bed ridden, the bed pan is the only option. Using a bed pan can be a very awkward procedure, not to mention demeaning and embarrassing. In addition, lying over the bed pan and raising the mid-section of the body can be very painful. Consequently, there is a need for a device that facilities the use of a bed pan with dignity for those people who are bed ridden.

SUMMARY OF THE INVENTION

According to its major aspects and broadly stated, the present invention is a mattress having a cut-out portion dimensioned to hold and support a bed pan so that it is recessed within the boundaries of the mattress. The mattress also has an insert that fits within the cut-out portion to provide a flat comfortable surface for a person to lie on when the bed pan is removed from the cut-out portion and not in use. In the preferred embodiment, the mattress is constructed from a foam-type material as opposed to bed springs.

In addition, a first fitted sheet is designed to fit about the mattress and within the cut-out portion. A second fitted sheet is provided that fits around the insert, so that when the insert is positioned within the cut-out portion, the mattress not only provides a flat surface, but is also completely covered by the first and second fitted sheets.

The mattress is normally positioned with the insert within the cut-out portion, so that when a person is lying on the bed, there are no apparent discontinuities with the bed; that is, the surface of the bed is at essentially at the same level including at the insert and has the same resilience throughout so that the insert supports the body of the user to the same extent as the balance of the mattress. However, when it is necessary for that person to perform their excretory functions, the insert is removed from the mattress and a bed pan inserted within the cut-out portion. After the necessary functions have been performed, the bed pan is removed and the insert is replaced within the cut-out portion.

A major feature of the present invention is the cut-out portion dimensioned specifically for receiving a bed pan. When the bed pan is positioned within the cut-out portion, the bed pan is recessed within the boundaries of mattress.

The cut-out portion also will hold the bed pan stable, so that the bedridden person will not need assistance steadying the bed pan. Therefore, it is easier for a bed ridden person to perform these excretory functions when the bed pan is lower, in the cut-out portion, rather than lying on top of and over the bed pan. In addition, once the excretory functions have been performed, the insert may be repositioned to again provide a flat mattress.

Another feature of the present invention are the fitted sheets. The first fitted sheet surrounds the mattress and matches the contour of the cut-out portion, while the second fitted sheet surrounds the insert. The combination of the two fitted sheets provides a sanitary covering for the mattress and insert.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Referring now to the figures, a mattress 20 having a centrally located cut-out portion 40 is shown according to a preferred embodiment of the present invention. By "centrally located", it is meant that cutout portion 40 is located generally between the head and the foot of the mattress and between the sides in a single mattress. In wider mattresses, cutout portion 40 is preferably located nearer to one side. Mattress 20 is preferably rectangular in shape, having approximately the same dimensions as either a single, double, queen, or king size mattress. In addition, mattress 20 is constructed from a heavy natural or synthetic rubber foam 22 that those skilled in the art will recognize as both suitable for mattress construction and currently in use for that purpose.

Figure 4:
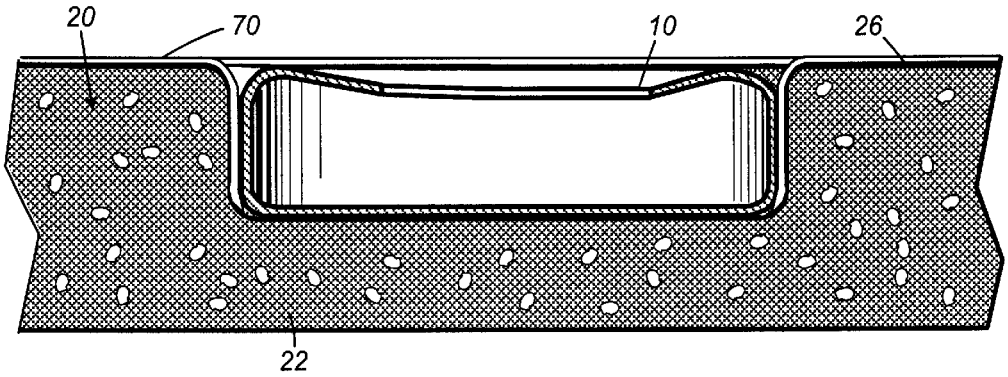
FIG. 4 is a partial cross-sectional view of the mattress and bed pan according to a preferred embodiment of the present invention.

Cut-out portion 40 is preferably centrally located with respect to the sides 24 of mattress 20, being no closer to one side than the others. Cut-out portion 40 opens on the top 26 of mattress 20, extends approximately half-way through the thickness of mattress 20, and is sized slightly larger than and the same shape as bed pan 10. The specific placement of cut-out portion 40 is not critical to the present invention; however, the depth of cut-out portion 40 should be enough that when bed pan 10 is inserted therein, bed pan 10 is positioned within the boundaries of mattress 20. (See FIG. 4). The boundaries of mattress 20 are defined by the top 26, sides 24, and bottom 28 of mattress 20.

Figure 1:
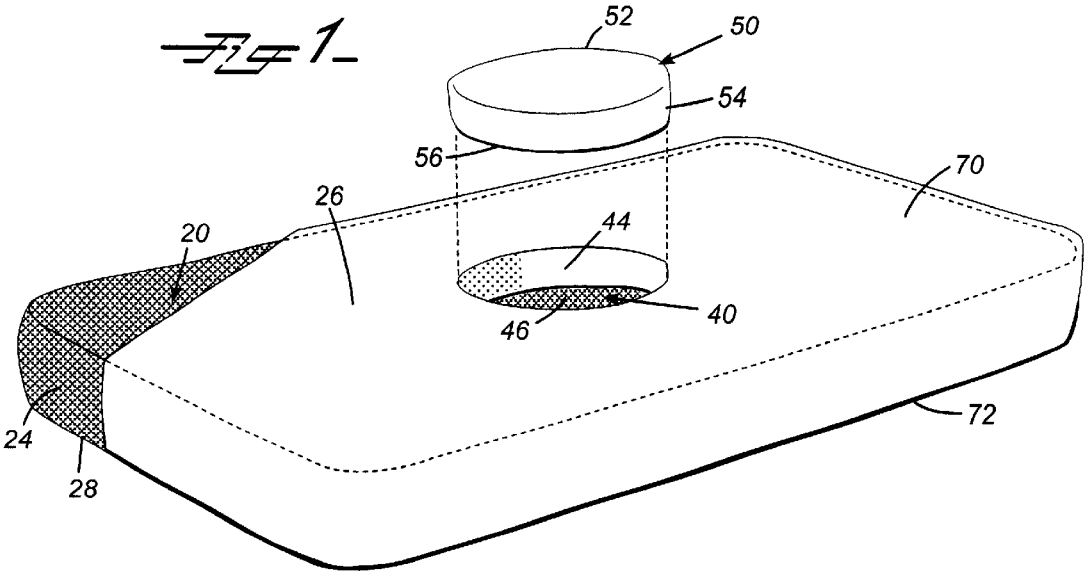
FIG. 1 is an exploded perspective view of a mattress and insert according to a preferred embodiment of the present invention.

The present invention also comprises an insert 50 having the same size and shape as cut-out portion 40 and which is positionable within cut-out portion 40, as shown in FIGS. 1 and 2. Insert 50 is designed to fit within cut-out portion 40 to complete mattress 20, so that top 26 of mattress 20 is relatively flat, thus providing a comfortable surface on which a person can lie. Furthermore, in the preferred embodiment, insert 50 is constructed from the same foam 22 as mattress 20. In use, mattress 20 is positioned within a frame to form a complete bed having a level surface and uniform resiliency when insert 50 is in position in cutout portion 40 of mattress 20.

Figure 2:
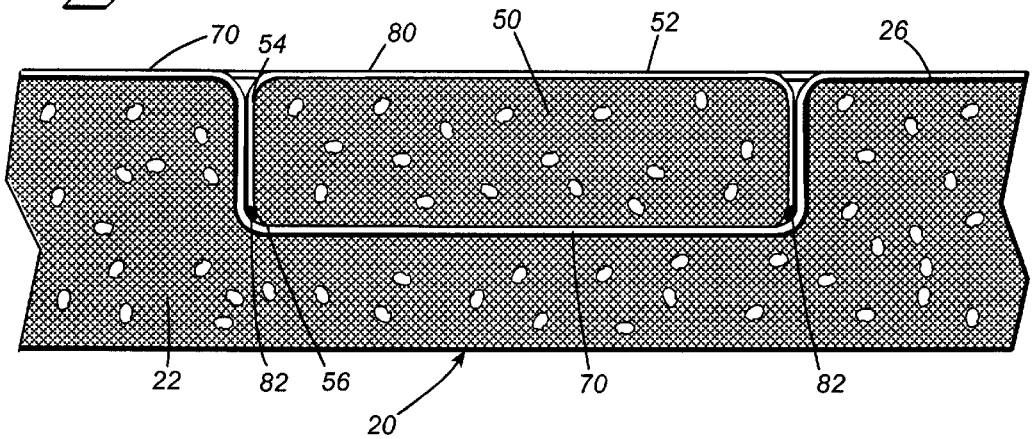
FIG. 2 is a partial cross-section view of the mattress and insert according to a preferred embodiment of the present invention.
Figure 3:
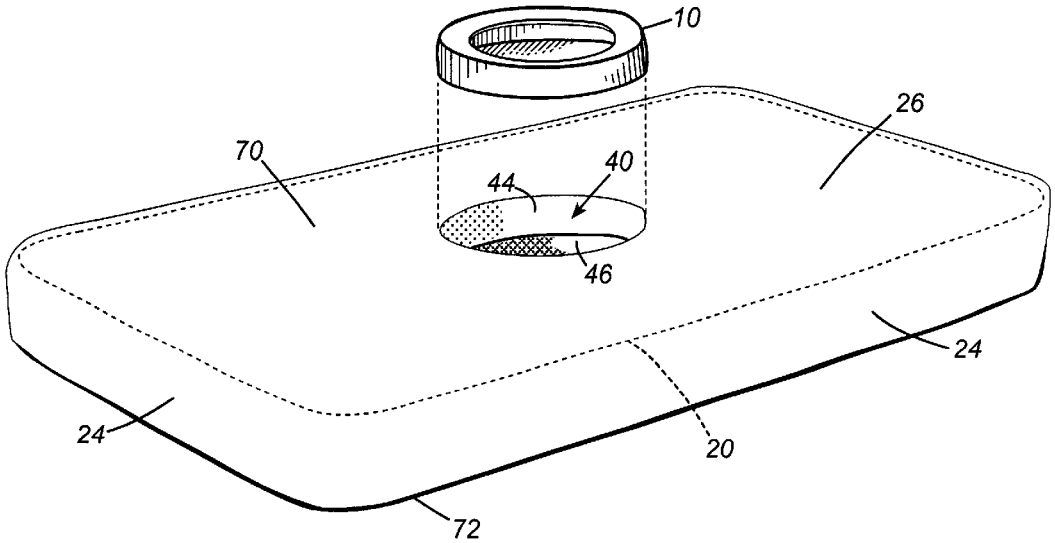
FIG. 3 is an exploded perspective view of a mattress and bed pan according to a preferred embodiment of the present invention.

A first fitted sheet 70 and second fitted sheet 80 are also provided with the present invention. First fitted sheet 70 surrounds the top 26 and sides 24 of mattress 20 and grabs the bottom edges 28 of mattress 20. First fitted sheet 70 can be secured about bottom edges 28 by any means known to those skilled in the art, including the use of elastic bands 72, as is done in a conventional fitted sheet. First fitted sheet 70, however, differs from the conventional fitted sheet in that first fitted sheet 70 is designed to fit within cut-out portion 40. First fitted sheet 70 may either extend within cut-out portion 40 and completely cover the inner surfaces of cut-out portion 40, including the sides 44 and floor 46, as shown in FIG. 2, or first fitted sheet 70 may be designed to extend down the inner sides 44 of cut-out portion 40, as shown in FIG. 1. In either case, the first fitted sheet 70 performs its function to cover those areas of mattress 20 that would be in contact with a person lying on the bed. Furthermore, by extending the first fitted sheet 70 within cut-out portion 40, first fitted sheet 70 is secured about the perimeter of cut-out portion 40, so that mattress 20 will not readily be uncovered.

Second fitted sheet 80 surrounds insert 50 by grabbing its bottom edges 56 with preferably an elastic band 82, much the same way first fitted sheet 70 is secured about mattress 20. Second fitted sheet 80 covers the top 52 and sides 54 of insert 50, so that when insert 50 is positioned within cut-out portion 40, mattress 20, and insert 50 are completely covered by sheets 70 and 80. By covering mattress 20 and insert 50 such that sheets 70 and 80 are not easily or inadvertently removed therefrom—for example by the movement of a person lying on mattress 20—a convenient replaceable sanitary covering is provided. In addition, it will be recognized that sheets 70 and 80 can be constructed of any suitable material and weave that sheets are normally made from, including cotton and percale, respectively.

In use, insert 50 is positioned within mattress 20 having second fitted sheet 80 and first fitted sheet 70 respectively secured thereon, thus providing a relatively flat surface on which a person can lie. When this person needs to perform their excretory functions and is unable to get out of bed, the person is rolled to one side, thus gaining access to insert 50. After insert 50 is removed, a bed pan 10 is inserted within cut-out portion 40, and the person rolled thereover. Once in position, the person is able to discretely and comfortably perform their excretory functions. Upon completion, the person is rolled to one side, again gaining access to cut-out portion 40. The bed pan 10 is removed and insert 50 replaced therein, thus returning mattress 20 to its flat comfortable state. In addition, when it is necessary to change first and second fitted sheets 70 and 80, sheets 70 and 80 are removed from mattress 20 and insert 50 respectively and then replaced, thus maintaining the sanitary condition of the bed.

It will be apparent to those skilled in the art that many changes and substitutions can be made to the preferred embodiment herein described without departing from the spirit and scope of the present invention as defined by the appended claims.

What is claimed is:

1. An article of manufacture, comprising:

a mattress having a cutout portion dimensioned and shaped to receive a bedpan, said mattress having a thickness and said cutout portion extending only partway through said thickness of said mattress, said mattress having a top and sides, said cutout portion defined by sides and a floor, said bedpan resting on said floor of said cutout portion in said mattress when said bedpan is placed into said cutout portion;

an insert dimensioned to fit within said cutout portion, said insert filling said cutout portion and having the same resilience when placed in said cutout portion as said mattress;

a first removable fitted sheet dimensioned to cover said top and said sides of said mattress and to cover said walls and said floor of said cutout portion; and a second fitted sheet covering said cutout portion.

2. The article as recited in claim 1, wherein said first and said second fitted sheets are made of cotton.

3. The article as recited in claim 1, wherein said mattress and said insert are made of synthetic foam rubber.

* * * * *